US006120269A

United States Patent [19]

Iizuka et al.

[11] Patent Number: 6,120,269

[45] Date of Patent: Sep. 19, 2000

[54] SCROLL TYPE COMPRESSOR

[75] Inventors: Jiro Iizuka; Satoru Saito, both of Takasaki, Japan

[73] Assignee: Sanden Corporation, Gunma, Japan

[21] Appl. No.: 09/137,819

[22] Filed: Aug. 21, 1998

[30] Foreign Application Priority Data

Aug. 29, 1997 [JP] Japan ..... 9-233777

[51] Int. Cl.[7] ..... F04C 18/00

[52] U.S. Cl. ..... 418/55.3; 418/55.2; 418/1

[58] Field of Search ..... 418/55.2, 55.3, 418/1

[56] References Cited

U.S. PATENT DOCUMENTS

| | | | |
|---|---|---|---|
| 5,141,417 | 8/1992 | Bush | 418/55.3 |
| 5,188,521 | 2/1993 | Kawahara et al. . | |
| 5,281,114 | 1/1994 | Bush . | |
| 5,547,353 | 8/1996 | Yamaguchi et al. . | |
| 5,775,893 | 7/1998 | Takao et al. | 418/55.2 |

FOREIGN PATENT DOCUMENTS

| | | | |
|---|---|---|---|
| 63-88288 | 4/1988 | Japan | 418/55.3 |
| 3-281996 | 12/1991 | Japan | 418/55.3 |
| 08049670 | 2/1996 | Japan . | |
| 10-331782 | 12/1998 | Japan | 418/55.3 |

*Primary Examiner*—Thomas Denion
*Assistant Examiner*—Thai-Ba Trieu
*Attorney, Agent, or Firm*—Baker Botts L.L.P.

[57] ABSTRACT

This invention provides a scroll type compressor employing an Oldham coupling producing little vibration or noise and in which components thereof are easy to produce by means of a lathe. The Oldham coupling blocks a rotation of a movable scroll member 4. A direction of a reciprocation of the Oldham coupling 16 coincides with a minor axis of an elliptic circulating orbit of the movable scroll member 4. When a total mass of the movable scroll member 4 and parts circulating elliptically together therewith is ma, a mass of an Oldham ring 16 is mb, a radius of a minor axis of an elliptic circulating orbit is $R_Y$ and a radius of a major axis of the elliptic circulating orbit is $R_X$, a relation of $R_X$=(1+mb/ma) $R_Y$ is established.

18 Claims, 6 Drawing Sheets

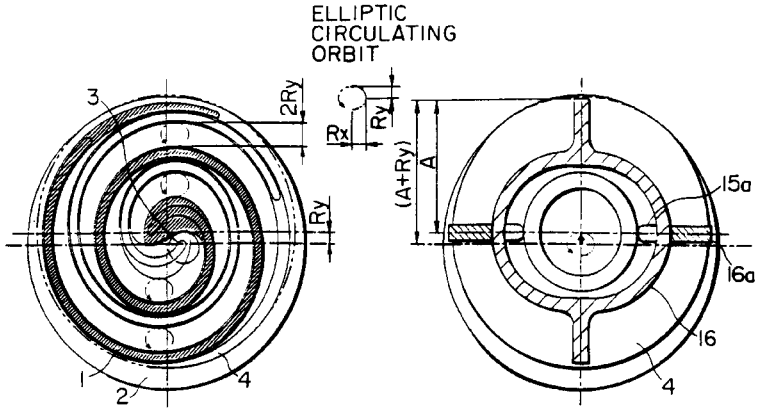
FIG. 4A
FIG. 4B
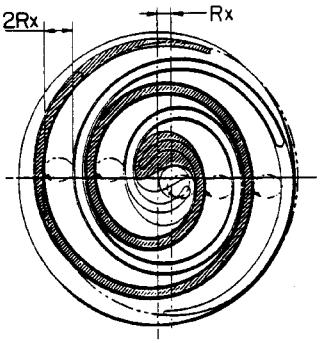
FIG. 4C
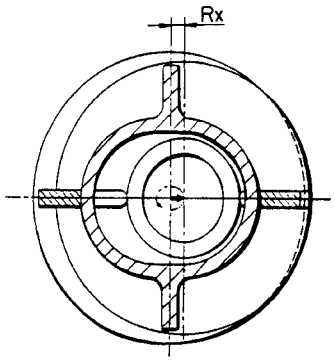
FIG. 4D

SCROLL TYPE COMPRESSOR

BACKGROUND OF THE INVENTION

1. Field of the Invention

This invention relates to a scroll type compressor for use in vehicle air conditioning system, general refrigeration air conditioning system, heat pump, air compressor and the like.

2. Description of the Prior Art

A conventional scroll type compressor of the first type has been proposed in, for example, Japanese Patent Unexamined Publication (JP-A) No. 8-49670 (1996).

In this scroll type compressor, a first housing in which a bottom plate and a scroll portion are integrally formed and which acts also as a fixed scroll member and a second housing accommodating a movable scroll member having a bottom plate and a scroll portion are engaged with each other at their scroll portions so as to form a compression chamber in both housings. By revolving the movable scroll member around an axis of the fixed scroll member, the compression chamber is moved from their peripheral walls to a center portion so as to compress gas. Sectional shape of each of both housings is nearly elliptic.

A conventional scroll type compressor of the second type will be described with reference to FIGS. 1 and 2.

A fixed scroll member 11 is formed integrally with a disc-like bottom plate 12 and a movable scroll member 14 is formed integrally with a bottom plate 15. The movable scroll member 14 is engaged with the fixed scroll member 11 so that it is capable of circulating under a predetermined circulation radius $R_0$. A discharge hole 13 is provided in a center of the disc-like bottom plate 12.

An Oldham coupling will be described with reference to FIG. 2. A bottom plate 15 formed integrally with the movable scroll member 14 has key grooves 15*a*, 15*a* on both sides in the X-axis direction. A boss 15*b* is provided at an eccentric position such that a bearing is fit thereto. An Oldham ring 16 has keys 16*a*, 16*a* on both sides in the X-axis direction and has keys 16*b*, 16*b* in the Y-axis direction. A housing 17 has key grooves 17*a*, 17*a* on both sides in the Y-axis direction.

The keys 16*a*, 16*a* of the Oldham ring 16 are fit to the key grooves 15*a*, 15*a* of the bottom plate 15 and the keys 16*b*, 16*b* of the Oldham ring 16 are fit to the key grooves 17*a*, 17*a* of the housing 17. Therefore, the movable scroll member 14 is capable of moving both in the X-axis and Y-axis directions relative to the housing 17.

In FIG. 1B, if the Oldham ring 16 reciprocates in the Y-axis direction, the movable scroll member 14 is prevented from its rotation by the Oldham coupling, so that it is driven along a circulation orbit of a perfect circle. FIGS. 1C and 1D show respectively a status after a phase of each of the movable scroll member 14 and the Oldham ring 16 is changed. Incidentally, the length of the arm of the Oldham ring 16 is assumed to be A.

Due to a reciprocation of the Oldham ring 16, a centrifugal force changes during one rotation of the movable scroll member 14, thereby producing a vibration. If a total mass of a movable scroll member 14 and parts circulating together therewith is ma and a mass of the Oldham ring 16 is mb, a circulation radius of the movable scroll member 14 is $R_0$ and an angular speed of the movable scroll member 14 is ω, a component $F_Y$ in the Y-axis direction of a centrifugal resultant force ΣF and a component $F_X$ in the X-axis direction of the same are expressed by the following formulae, $$F_Y=(ma+mb)R_0\omega^2$$

$$F_X=maR_0\omega^2$$

In the aforementioned conventional scroll type compressor of the first type, since the movable scroll member moves along an elliptic circulating orbit, the centrifugal force changes depending on a position of the volute (phase angle), so that vibration and noise are generated. Further, since major parts of the compressor such as the movable scroll member, the fixed scroll member, the housing and the like are all formed in the shape based on an ellipse, they cannot be processed easily by cutting work by means of a lathe. Therefore, the production cost is high.

In the aforementioned conventional scroll type compressor of the second type, vibration and noise are generated by the reciprocation of the Oldham ring.

SUMMARY OF THE INVENTION

Accordingly, an object of the present invention is to provide a scroll type compressor employing an Oldham coupling which produces little vibration and noise.

Another object of the present invention is to provide main parts easy to produce by cutting work, of the scroll type compressor employing the Oldham coupling.

To achieve the above object, the present invention provides a scroll type compressor comprising a fixed scroll member in which a scroll portion is erected on a circular bottom plate and which is accommodated in a housing, and a movable scroll member supported opposing the fixed scroll member so as to form a compression chamber between itself and the fixed scroll member, the scroll type compressor further including an Oldham coupling constituted of the movable scroll member having key grooves, freely slidably fit to an Oldham ring disabling a rotation of the movable scroll member and enabling a revolution thereof along an elliptic orbit, wherein a direction of a reciprocation of the Oldham ring substantially coincides with a minor axis of an elliptic circulating orbit of the movable scroll member.

BRIEF DESCRIPTION OF THE DRAWINGS

FIG. 4A is a sectional view showing a state before the phase of the movable scroll member is changed in the scroll type compressor of a first embodiment of the present invention;

FIG. 4B is a sectional view showing a state before the phase of the Oldham ring is changed in the scroll type compressor of the first embodiment of the present invention;

FIG. 4C is a sectional view showing a state after the phase of the movable scroll member is changed in the scroll type compressor of the first embodiment of the present invention;

FIG. 4D is a sectional view showing a state after the phase of the Oldham ring is changed in the scroll type compressor of the first embodiment of the present invention;

DESCRIPTION OF THE PREFERRED EMBODIMENTS

Two embodiments of the present invention will be described with reference to FIGS. 3–6. Incidentally, since its Oldham coupling is the same as the conventional art, a description thereof is omitted. However, the present invention is different from the conventional art in that the circulating motion of its movable scroll member is elliptic whereas that of the conventional art is circular.

Figure 1B:
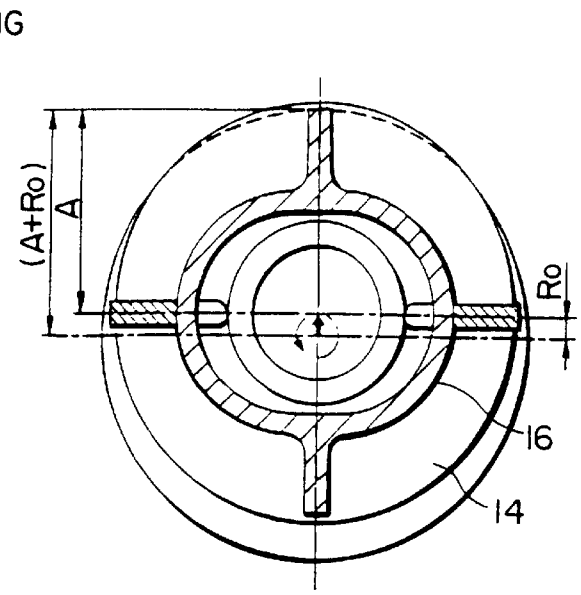
FIG. 1B PRIOR ART
FIG. 1B is a sectional view showing a state before the phase of an Oldham ring is changed in the conventional scroll type compressor.
Figure 1A:
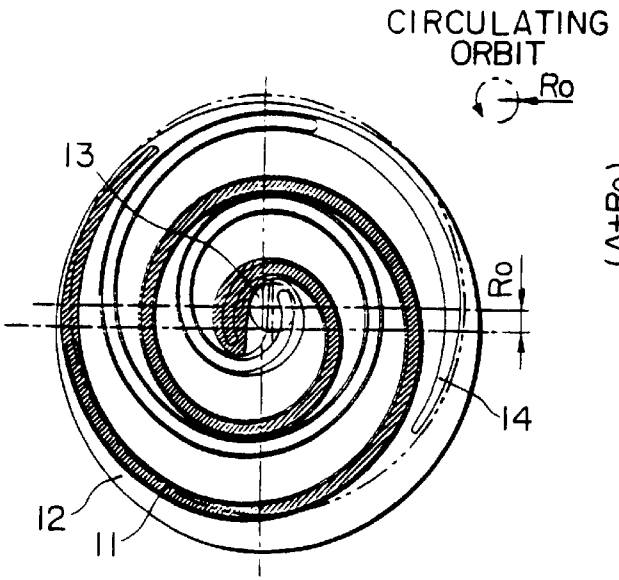
FIG. 1A PRIOR ART
FIG. 1A is a sectional view showing a state before a phase of a movable scroll member is changed in a conventional scroll type compressor.
Figure 1D:
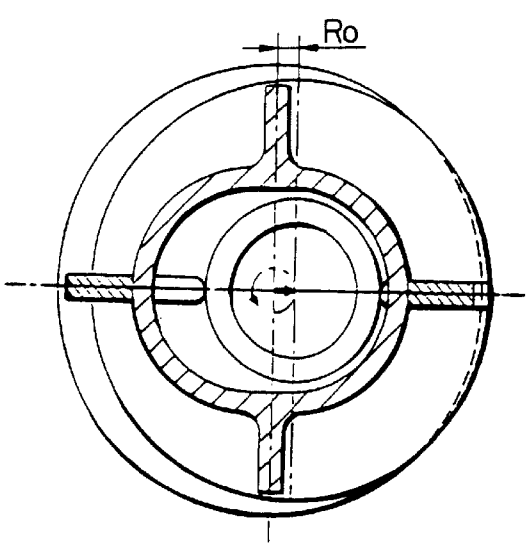
FIG. 1D PRIOR ART
FIG. 1D is a sectional view showing a state after the phase of the Oldham ring is changed in the conventional scroll type compressor.
Figure 1C:
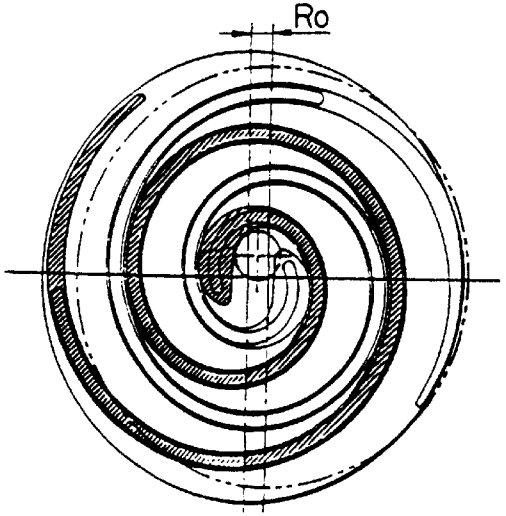
FIG. 1C PRIOR ART
FIG. 1C is a sectional view showing a state after the phase of the movable scroll member is changed in the conventional scroll type compressor.
Figure 2:
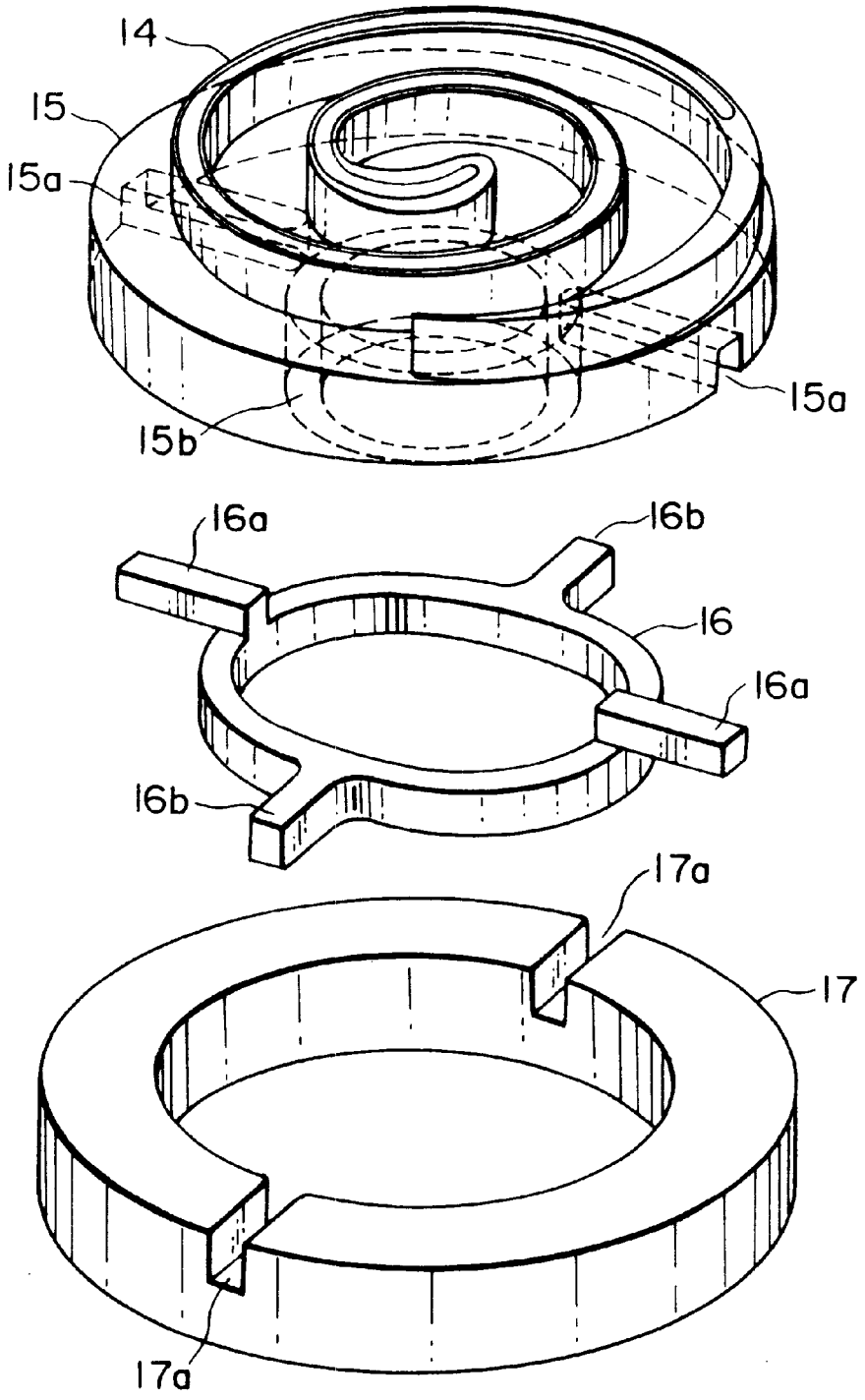
FIG. 2 PRIOR ART
FIG. 2 is a disassembly perspective view of the Oldham coupling in the conventional scroll type compressor.
Figure 3:
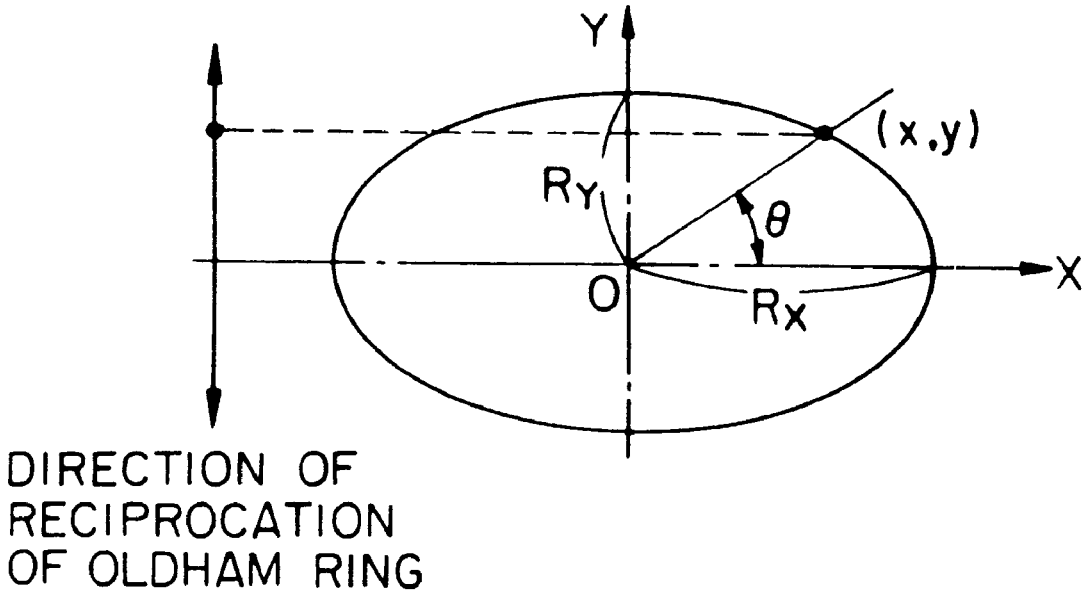
FIG. 3 is a diagram for explaining an elliptic circulating motion of the movable scroll member in a scroll type compressor of the present invention.
Figures 5A, 5B, 5C, 5D:
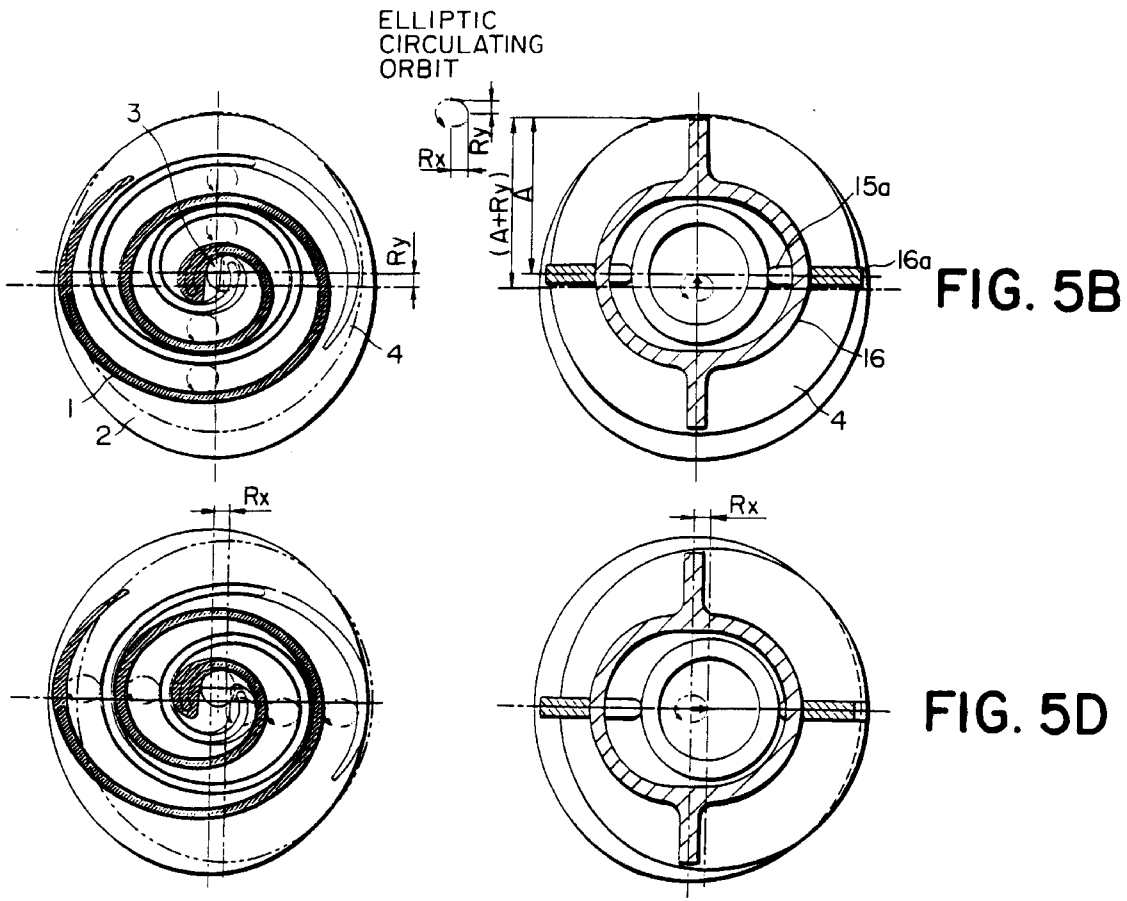
FIG. 5A is a sectional view showing a state before the phase of the movable scroll member is changed in the scroll type compressor of a second embodiment of the present invention.
FIG. 5B is a sectional view showing a state before the phase of the Oldham ring is changed in the scroll type compressor of the second embodiment of the present invention.
FIG. 5C is a sectional view showing a state after the phase of the movable scroll member is changed in the scroll type compressor of the second embodiment of the present invention.
FIG. 5D is a sectional view showing a state after the phase of the Oldham ring is changed in the scroll type compressor of the second embodiment of the present invention.

First, an elliptic circulating motion of the movable scroll member in the present invention will be described with reference to FIG. 3.

The movable scroll member circulates along an elliptic orbit. If a point on the ellipse is expressed as (x, y), a following formula (1) is established.

$$x=R_X\cdot\cos\theta y=R_Y\cdot\sin\theta x^2+y^2=R_X^2\cdot\cos^2\theta+R_Y^2\cdot$$

$$\sin^2\theta=R_X^2\cdot\cos^2\theta+R_Y^2\cdot(1-\cos^2\theta)=R_Y^2+(R_X^2-R_Y^2)\cos^2\theta=R_Y^2+$$

$$(R_X^2-R_Y^2)\ (1+\cos 2\theta)/2=(R_X^2+R_Y^2)/2+[(R_X^2-R_Y^2)/2]\cdot\cos 2\theta \quad (1)$$

A distance l from an origin O to a point on the ellipse is given by the following formula (2).

$$l=\sqrt{x^2+y^2}=\sqrt{(R_X^2+R_Y^2)/2+[(R_X^2-R_Y^2)/2]\cdot\cos 2\theta} \quad (2)$$

Generally, a centrifugal force F acting on a rotating member is expressed as follows if a mass of the member is m, its rotation radius (1) is r and angular speed is ω, $$F=mr\omega^2$$

If the total mass of a movable scroll member and parts circulating elliptically is ma and a mass of the Oldham ring is mb, a component $F_Y$ in the Y-axis direction of a centrifugal resultant force ΣF and a component $F_X$ in the X-axis direction of the same are expressed as follows.

$$F_Y=(ma+mb)l\omega^2\sin\theta$$

$$F_X=mal\omega^2\cos\theta$$

In the event that θ=0° and θ=90° under which a difference in the centrifugal resultant force ΣF is remarkable, the centrifugal force F respectively becomes as follows.

$$F=F_Y=(ma+mb)R_Y\omega^2$$

$$F=F_X=maR_X\omega^2$$

If there is a relation of $R_X=(1+mb/mb)R_Y$, it follows that $F_X=F_Y$, so that the centrifugal force (vibrating force) of the movable scroll member in a circulating motion becomes nearly constant. As a result, this force can be balanced by a corresponding counterweight.

Figure 6:
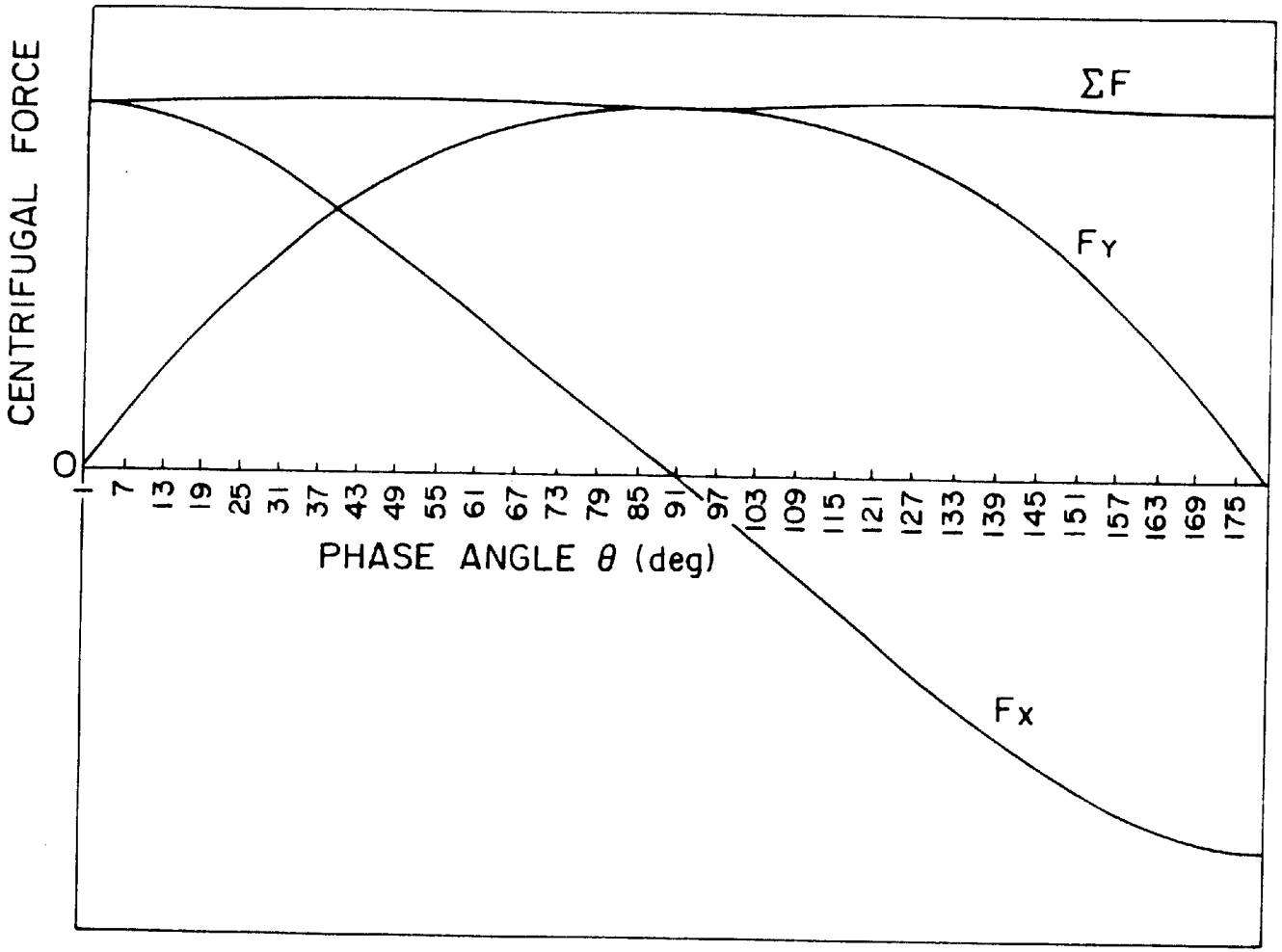
FIG. 6 is a graph showing a result of calculation on a relation between the phase angle and centrifugal force in the movable scroll member of the scroll type compressor of the first embodiment of the present invention.

FIG. 6 shows a result of calculation on a relation between the phase angle of the movable scroll member and centrifugal force in an embodiment of the present invention.

Next, a first embodiment of the present invention will be described with reference to FIGS. 3–4.

In FIG. 4A, a fixed scroll member 1 is accommodated in a housing under such a condition that its scroll portion is erected on a circular bottom plate 2. A movable scroll member 4 is supported by the bottom plate (not shown) opposing the fixed scroll member 1 so as to form a compression chamber between itself and the fixed scroll member 1 and engages with the fixed scroll member 1 such that it is capable of circulating elliptically. A discharge hole 3 is provided in a center of the circular bottom plate 2.

Respective walls of the movable scroll member 4 and the fixed scroll member 1 are formed as follows.

(1) A range of the outermost arc from 0° to 180° is a first involute curve in which a perfect circle is the first involute curve's fundamental circle and an arc leading from there to a center is a second involute curve in which an ellipse obtained by stretching the fundamental circle of the perfect circle in the direction of a reciprocation of the Oldham ring is the third involute curve's fundamental circle.

(2) A range of the outermost arc from 0° to 180° is an arc and an arc leading from there to a center is a shape obtained by enveloping an ellipse stretched in the direction of the reciprocation of the Oldham ring with a continuous ellipse on the axis of the reciprocation of the Oldham ring sharing a tangent line.

(3) A range of the outermost arc from 0° to 180° is an involute curve in which a perfect circle is its fundamental circle and an arc leading from there to a center is a shape obtained by enveloping an ellipse stretched in the direction of the reciprocation of the Oldham ring with a continuous ellipse on the axis of the reciprocation of the Oldham ring sharing a tangent line.

(4) A range of the outermost arc from 0° to 180° is an arc and an arc leading from there to a center is a fourth involute curve in which an ellipse obtained by stretching a perfect circle as its fundamental circle in the direction of the reciprocation of the Oldham ring is the fourth involute curve's fundamental circle.

To allow the movable scroll member 4 to circulate elliptically, there is ensured a difference in pitch of the scroll wall ($2R_X$, $2R_Y$) between the X-axis direction and Y-axis direction.

The thickness of a central portion of the scroll wall can be increased in the direction of a minor axis of the circulation orbit.

If the Oldham ring 16 reciprocates in the the Y-axis direction, the movable scroll member 4 is prevented from its rotation by the Oldham coupling, so that it is driven along an elliptic circulating orbit. FIGS. 4C and 4D respectively show a state after a phase of each of the movable scroll member 4 and the Oldham ring 16 is changed. Meanwhile, the length of the arm of the Oldham ring 16 is assumed to be A.

If the total mass of the movable scroll member 4 and parts circulating together therewith is ma and a mass of the Oldham ring is mb, the circulation radius of the movable scroll member in the Y-axis direction and X-axis direction is $R_Y$ and $R_X$ respectively, and the angular speed of the movable scroll member 4 is ω, a component $F_Y$ in the Y-axis direction of a centrifugal resultant force ΣF and a component $F_X$ in the X-axis direction thereof are expressed as follows, $$F_y=(ma+mb)R_Y\omega^2$$

$$F_X=maR_X\omega^2$$

where $R_Y<R_X$.

If $R_X=R_0$, $(A+R_0)>(A+R_Y)$ is established, so that the diameter of the body of a compressor in the Y-axis direction can be reduced or the length of the key can be prolonged, so that the bearing force applied on the key is reduced, thereby leading to improvement of the durability.

Further, if such a relation as $(ma+mb)R_Y=maR_Y$ is established and about the part mass and circulation radius, $F_Y=F_X$ is established and so and no change occurs in a centrifugal force on the movable scroll member 4 and the like by the reciprocation of the Oldham ring 16 during a single circulation. No vibration or noise is produced.

Next, a second embodiment of the present invention will be described with reference to FIGS. 5A–5D. However, a description of the same matters as the first embodiment is omitted.

Respective scroll walls of the movable scroll member 4 and the fixed scroll member 1 are formed as follows.

(5) An entire range is an involute curve in which an ellipse compressed in the direction of the reciprocation of the Oldham ring is its fundamental circle.

(6) An entire range is elliptic.

(7) A range of the outermost arc from 0° to 180° is an involute curve in which an ellipse compressed in the direction of the reciprocation of the Oldham ring is its fundamental circle and an arc leading from there to a center is elliptic.

(8) A range of the outermost arc from 0° to 180° is elliptic and an arc leading from there to a center is an involute curve in which an ellipse compressed in the direction of the reciprocation of the Oldham ring is its fundamental circle.

As evident from the above description, according to the present invention, the following effects are achieved.

(1) It is possible to provide a scroll type compressor employing the Oldham coupling which produces little vibration and noise.

(2) Since the housing, the bottom plate of the movable scroll member and the bottom plate of the fixed scroll member are formed in the shape based on a circle, they are easy to produce by the lathe.

(3) By increasing the thickness of the central portion of the scroll wall, the durability of the scroll type compressor can be improved.

What is claimed is:

1. A scroll type compressor comprising a fixed scroll member in which a scroll portion is erected on a circular bottom plate and which is accommodated in a housing, and a movable scroll member supported opposing said fixed scroll member so as to form a compression chamber between itself and said fixed scroll member, said scroll type compressor further including an Oldham coupling constituted of said movable scroll member having key grooves crossing perpendicularly to key grooves installed at said housing, freely slidably fit into an Oldham ring disabling a rotation of said movable scroll member and enabling a revolution thereof on an elliptic orbit determined by respective scroll walls of said movable scroll member and said fixed scroll member, wherein a direction of a reciprocation of said Oldham ring substantially coincides with a minor axis of an elliptic circulating orbit of said movable scroll member in said key grooves installed at said housing.

2. A scroll-type compressor as claimed in claim 1, wherein respective scroll walls of said movable scroll member and said fixed scroll member to be combined therewith are so constructed that a range of an outermost arc from 0° to 180° is a first involute curve in which a perfect circle is said first involute curve's fundamental circle and an arc leading therefrom to a center is a second involute curve in which an ellipse obtained by stretching said fundamental circle of said perfect circle in said direction of said reciprocation of said Oldham ring is said second involute curve's fundamental circle.

3. A scroll type compressor as claimed in claim 1, wherein respective scroll walls of said movable scroll member and said fixed scroll member to be combined therewith are so constructed that a range of an outermost arc from 0° to 180° is an arc and an arc leading therefrom to a center is a shape obtained by enveloping an ellipse stretched in said direction of said reciprocation of said Oldham ring with a continuous ellipse on the axis of said reciprocation of said Oldham ring sharing a tangent line.

4. A scroll type compressor as claimed in claim 1, wherein respective scroll walls of said movable scroll member and said fixed scroll member to be combined therewith are so constructed that a range of an outermost arc from 0° to 180° is an involute curve in which a perfect circle is the involute curve's fundamental circle and an arc leading therefrom to a center is a shape obtained by enveloping an ellipse stretched in said direction of said reciprocation of said Oldham ring with a continuous ellipse on the axis of said reciprocation of said Oldham ring sharing a tangent line.

5. A scroll type compressor as claimed in claim 1, wherein respective scroll walls of said movable scroll member and said fixed scroll member to be combined therewith are so constructed that a range of an outermost arc from 0° to 180° is an arc and an arc leading therefrom to a center is an involute curve in which an ellipse obtained by stretching said fundamental circle in said direction of said perfect circle in said direction of said reciprocation of said Oldham ring is the involute curve's fundamental circle.

6. A scroll type compressor as claimed in claim 1, wherein respective scroll walls of said movable scroll member and said fixed scroll member to be combined therewith are so constructed that an entire range is an involute curve in which an ellipse compressed in said direction of said reciprocation of said Oldham ring is the involute curve's fundamental circle.

7. A scroll type compressor as claimed in claim 1, wherein respective scroll walls of said movable scroll member and said fixed scroll member to be combined therewith are so constructed that an entire range is elliptic.

8. A scroll type compressor as claimed in claim 1, wherein respective scroll walls of said movable scroll member and said fixed scroll member to be combined therewith are so constructed that a range of an outermost arc from 0° to 180° is an involute curve in which an ellipse compressed in said direction of said reciprocation of said Oldham ring is the involute curve's fundamental circle and an arc leading therefrom to a center is elliptic.

9. A scroll type compressor as claimed in claim 1, wherein respective scroll walls of said movable scroll member and said fixed scroll member to be combined therewith are so constructed that a range of an outermost arc from 0° to 180° is elliptic and an arc therefrom to a center is an involute curve in which an ellipse compressed in said direction of said reciprocation of said Oldham ring is the involute curve's fundamental circle.

10. A scroll type compressor comprising a fixed scroll member in which a scroll portion is erected on a circular bottom plate and which is accommodated in a housing, and a movable scroll member supported opposing said fixed scroll member so as to form a compression chamber between itself and said fixed scroll member, said scroll type compressor further including an Oldham coupling constituted of said movable scroll member having key grooves, freely slidably fit into an Oldham ring disabling a rotation of said movable scroll member and enabling a revolution thereof on an elliptic orbit, wherein a direction of a reciprocation of said Oldham ring substantially coincides with a minor axis of an elliptic circulating orbit of said movable scroll member; wherein when it is supposed that a total mass of said movable scroll member and parts circulating elliptically together therewith is ma, a mass of said Oldham ring is mb, a radius of a minor axis of an elliptic circulating orbit is $R_Y$ and a radius of a major axis of said elliptic circulating orbit is $R_X$, a relation of $R_X=(1+mb/ma)R_Y$ is established.

11. A scroll-type compressor as claimed in claim 10, wherein respective scroll walls of said movable scroll member and said fixed scroll member to be combined therewith are so constructed that a range of an outermost arc from 0° to 180° is an involute curve in which a perfect circle in the involute curve's fundamental circle and an arc leading therefrom to a center is an involute curve in which an ellipse obtained by stretching said fundamental circle of said perfect circle in said direction of said reciprocation of said Oldham ring is the perfect curve's fundamental circle.

12. A scroll type compressor as claimed in claim 10, wherein respective scroll walls of said movable scroll member and said fixed scroll member to be combined therewith are so constructed that a range of an outermost arc from 0° to 180° is an arc and an arc leading therefrom to a center is a shape obtained by enveloping an ellipse stretching in said direction of said reciprocation of said Oldham ring with a continuous ellipse on the axis of said reciprocation of said Oldham ring sharing a tangent line.

13. A scroll type compressor as claimed in claim 10, wherein respective scroll walls of said movable scroll member and said fixed scroll member to be combined therewith are so constructed that a range of an outermost arc from 0° to 180° is an involute curve in which a perfect circle is the involute curve's fundamental circle and an arc leading therefrom to a center is a shape obtained by enveloping an ellipse stretched in said direction of said reciprocation of said Oldham ring with a continuous ellipse on the axis of said reciprocation of said Oldham ring sharing a tangent line.

14. A scroll type compressor as claimed in claim 10, wherein respective scroll walls of said movable scroll member and said fixed scroll member to be combined therewith are so constructed that a range of an outermost arc from 0° to 180° is an arc and an arc leading therefrom to a center is an involute curve in which an ellipse obtained by stretching said fundamental circle in said direction of said perfect circle in said direction of said reciprocation of said Oldham ring is the involute curve's fundamental circle.

15. A scroll type compressor as claimed in claim 10, wherein respective scroll walls of said movable scroll member and said fixed scroll member to be combined therewith are so constructed that an entire range is an involute curve in which an ellipse compressed in said direction of said reciprocation of said Oldham ring is the involute curve's fundamental circle.

16. A scroll type compressor as claimed in claim 10, wherein respective scroll walls of said movable scroll member and said fixed scroll member to be combined therewith are so constructed that an entire range is elliptic.

17. A scroll type compressor as claimed in claim 10, wherein respective scroll walls of said movable scroll member and said fixed scroll member to be combined therewith are so constructed that a range of an outermost arc from 0° to 180° is an involute curve in which an ellipse compressed in said direction of said reciprocation of said Oldham ring is the involute curve's fundamental circle and an arc leading therefrom to a center is elliptic.

18. A scroll type compressor as claimed in claim 10, wherein respective scroll walls of said movable scroll member and said fixed scroll member to be combined therewith are so constructed that a range of an outermost arc from 0° to 180° is elliptic and an arc leading therefrom to a center is an involute curve in which an ellipse compressed in said direction of said reciprocation of said Oldham ring is the involute curve's fundamental circle.

* * * * *